US008518079B2

(12) United States Patent
Sarver

(10) Patent No.: US 8,518,079 B2
(45) Date of Patent: Aug. 27, 2013

(54) TEETHING ASSEMBLY

(76) Inventor: Nicholas J. Sarver, Lafayette, LA (US)

( * ) Notice: Subject to any disclaimer, the term of this patent is extended or adjusted under 35 U.S.C. 154(b) by 169 days.

(21) Appl. No.: 13/216,312

(22) Filed: Aug. 24, 2011

(65) Prior Publication Data

US 2013/0053885 A1 Feb. 28, 2013

(51) Int. Cl.
*A61J 17/00* (2006.01)

(52) U.S. Cl.
USPC ..... 606/235

(58) Field of Classification Search
USPC ..... 606/234, 235, 236; 215/11.1, 11.2, 215/11.3, 11.4, 11.5; D24/193–197
See application file for complete search history.

(56) References Cited

U.S. PATENT DOCUMENTS

| | | | | |
|---|---|---|---|---|
| D160,140 | S | 9/1950 | Binney | |
| 2,595,462 | A * | 5/1952 | Johnson | 606/235 |
| 4,026,297 | A | 5/1977 | Kobayashi | |
| D314,627 | S * | 2/1991 | Picasso | D25/138 |
| 5,160,344 | A | 11/1992 | Werton | |
| 5,766,223 | A | 6/1998 | Johnson | |
| 6,056,774 | A | 5/2000 | Johansen et al. | |
| D651,718 | S * | 1/2012 | Grisham et al. | D24/195 |
| 2009/0100866 | A1 | 4/2009 | Creel | |
| 2009/0299410 | A1 * | 12/2009 | Brabant et al. | 606/235 |

* cited by examiner

*Primary Examiner* — Tuan V Nguyen

(57) ABSTRACT

A teething device includes a loop and a plurality of plates each having a top surface, a bottom surface and a perimeter edge. Each of the plates has an aperture that the loop extends through. Each of the plates is in the shape of a key and each is made of a metallic material. A plurality grommets is positioned on the perimeter edges of each plate. A teething member is mounted on the loop. The loop extends through the opening in the teething member. The teething member is used to provide comfort to a child while the child chews on the teething member.

5 Claims, 4 Drawing Sheets

TEETHING ASSEMBLY

BACKGROUND OF THE DISCLOSURE

Field of the Disclosure

The disclosure relates to teething device and more particularly pertains to a new teething device for entertaining and soothing a child.

SUMMARY OF THE DISCLOSURE

An embodiment of the disclosure meets the needs presented above by generally comprising a loop that is closed and free of any breaks. A plurality of plates is provided that each has a top surface, a bottom surface and a perimeter edge. Each of the plates has an aperture therein that the loop extends through. Each of the plates is in the shape of a key and each is made of a metallic material. A plurality of grommets made of a resiliently compressible material covers the perimeter edge of each key shaped plate. A teething member that provides comfort to a child has an opening therein through which loop extends.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
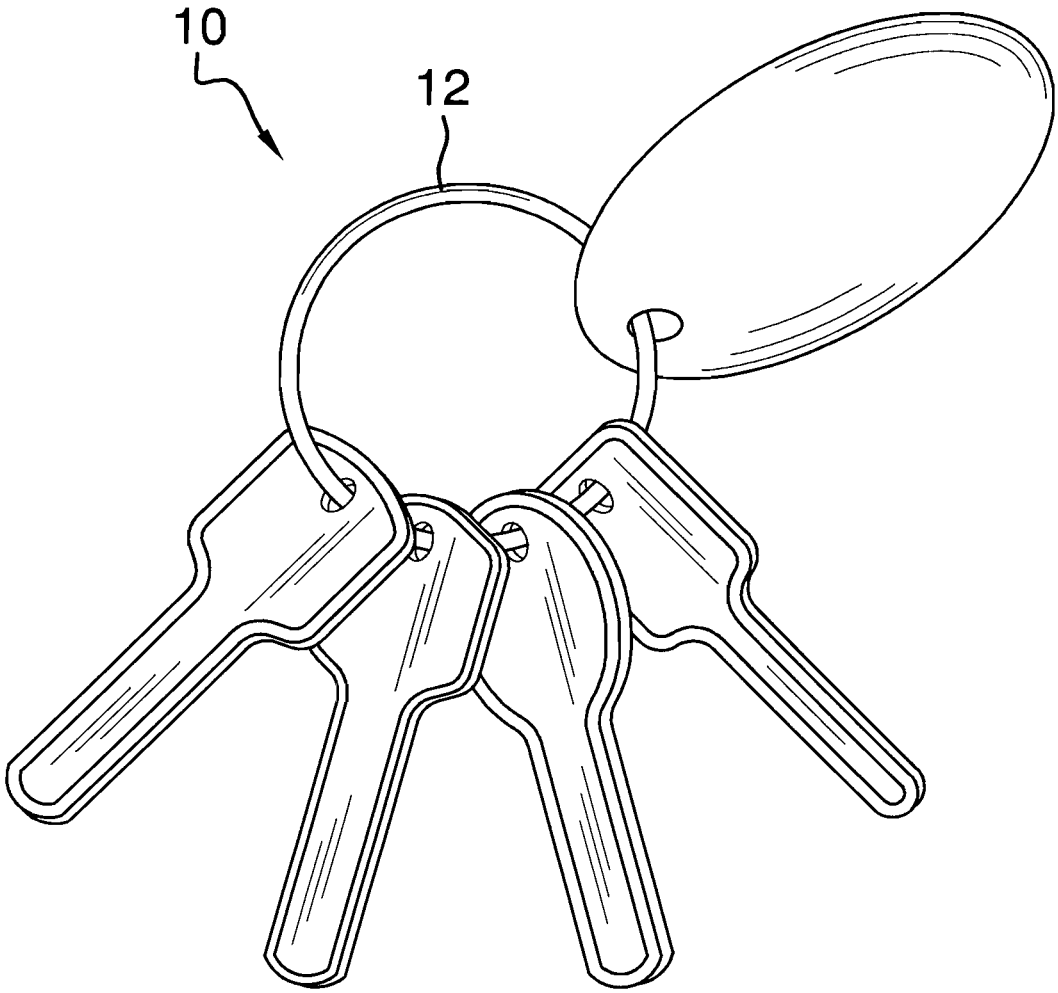
FIG. 1 is a top perspective view of a teething assembly according to an embodiment of the disclosure.
Figure 2:
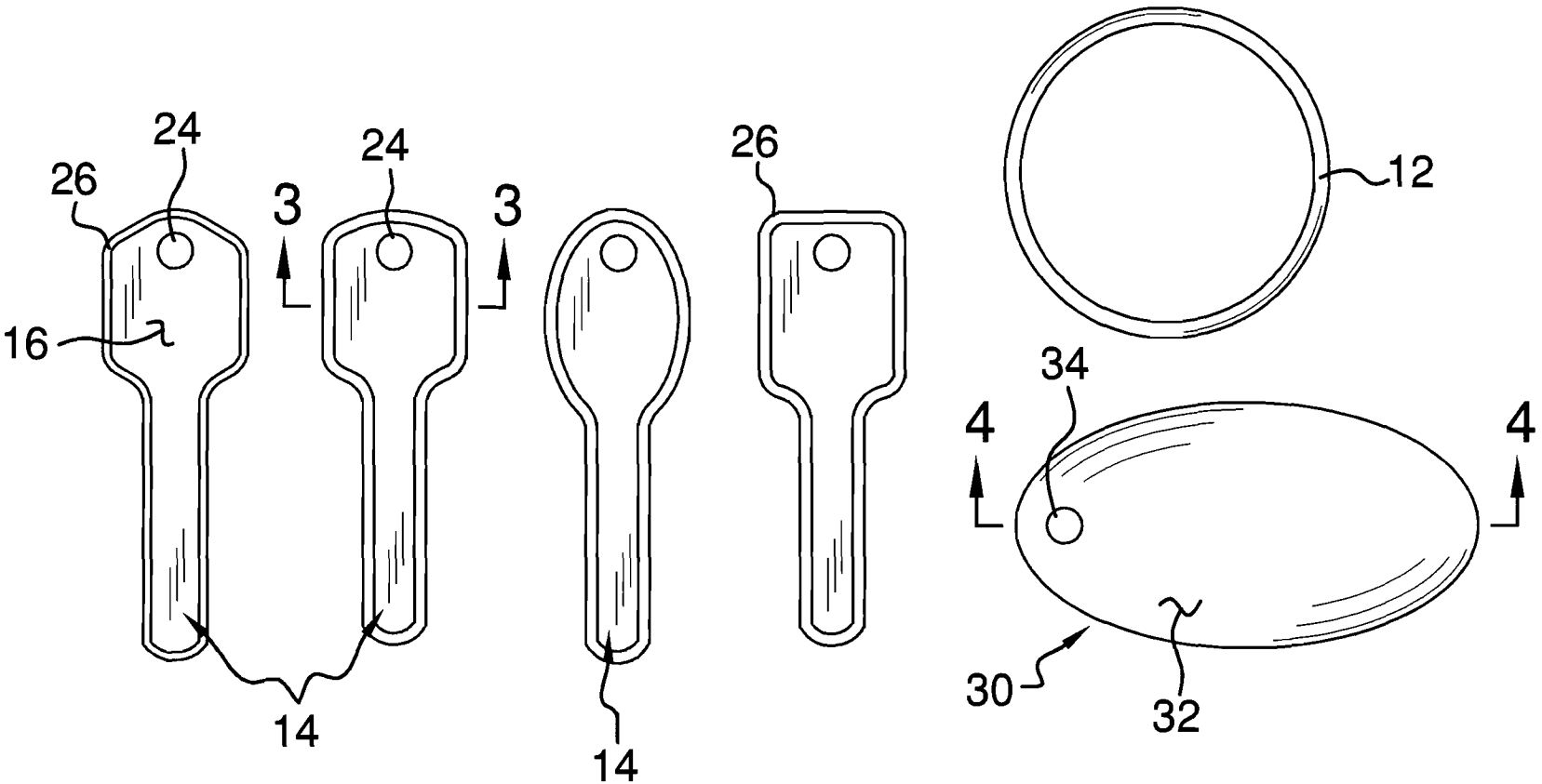
FIG. 2 is a top view of an embodiment of the disclosure.
Figure 3:
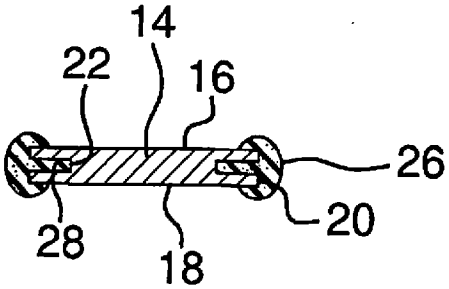
FIG. 3 is a cross-sectional view of an embodiment of the disclosure taken along line 3-3 of FIG. 2.
Figure 5:
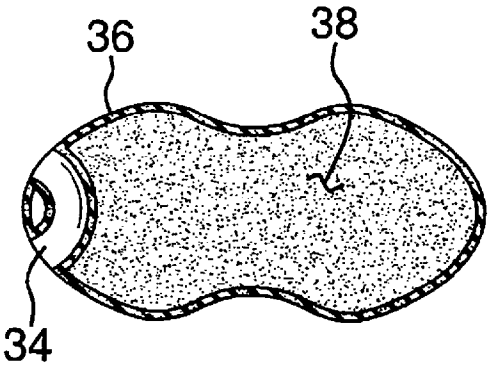
FIG. 5 is a cross sectional view of an embodiment of the disclosure in a compressed state.
Figure 4:
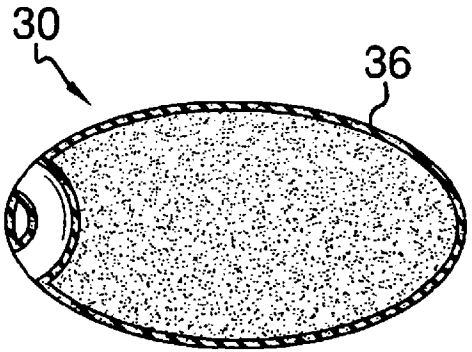
FIG. 4 is a cross-sectional view of an embodiment of the disclosure taken along line 4-4 of FIG. 2.
Figure 6:
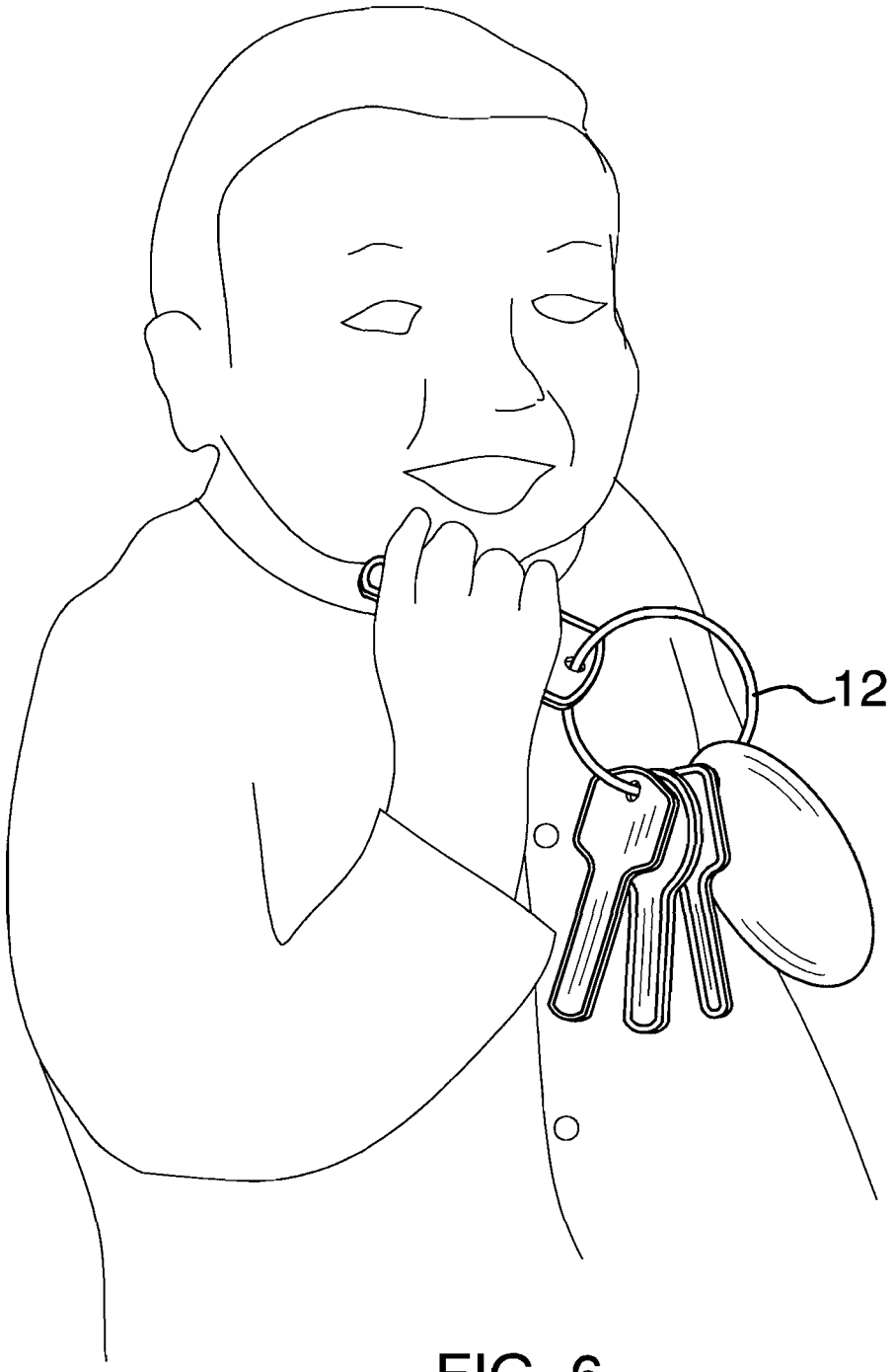
FIG. 6 is a perspective in-use view of an embodiment of the disclosure.

With reference now to the drawings, and in particular to FIGS. 1 through 6 thereof, a new teething device embodying the principles and concepts of an embodiment of the disclosure and generally designated by the reference numeral 10 will be described.

As best illustrated in FIGS. 1 through 6, the teething assembly 10 generally comprises a loop 12 that is closed and free of any breaks. The loop 12 may be comprised of any conventional material however a material which is resiliently compressible may be favored.

A plurality of plates 14 is provided and each has a top surface 16, a bottom surface 18 and a perimeter edge 20. The perimeter edge 20 of each of the plates 14 has a groove 22 that runs the entire length of the perimeter edge 20. Each of the plates 14 has an aperture 24 near their respective perimeter edges 20 that the loop 12 runs through. Moreover, each of the plates 14 is in the shape of a key and each is made of stainless steel. It has been found that toddlers are attracted to keys, in particular, and therefore the assembly 10 encourages a toddler to be attracted to the plates 14. Stainless steel not only provides aesthetically pleasing properties, but is also easy to maintain and clean.

A plurality of grommets 26 is provided and each is made of a resiliently compressible material. Each of the grommets 26 has an inner flange 28 that is inserted into the groove 22 on the perimeter edge 20 of each plate 14. The grommets 26 will cover the entire perimeter edge 20 of each plate 14 to protect a toddler's mouth from the perimeter edge.

A teething member 30 is mounted on the loop 12. The teething member 30 is used to provide comfort to a child in a conventional manner while they chew on the teething member 30. The teething member 30 is oblong and has a singular convexly arcuate outer surface 32 with an opening 34 for the loop 12 to pass through. The teething member 30 has an outer sheath 36 which is made of a flexible material such as a plastic or an elastomer. The outer sheath 36 is filled with a cushioning fluid 38 which may include a gel or other liquid which may or may not have heat storage capacity. This will allow the teething member 30 to be heated or cooled as needed.

In use, assembly 10 is given to the child and the plates 14 attract the child such that the child plays with the plates 14 while possibly biting on the grommets 26. The teething member 30 can be chewed on to provide the child comfort during teething.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A child's entertainment apparatus configured for play and chewing, said apparatus comprising:

a loop, said loop being closed and free of any breaks;

a plurality of plates, each of said plates having a top surface, a bottom surface and a perimeter edge, each of said plates having an aperture therein extending into corresponding ones of said top surfaces and said bottom surfaces, said loop extending through each of said apertures, each of said plates having the shape of a key, each of said plates comprising a metallic material;

a plurality of grommets comprising a resiliently compressible material, each of said perimeter edges being covered by one of said grommets, each of said grommets comprising a resiliently compressible material; and a teething member mounted on said loop, said teething member being configured to provide comfort to a child while being bit upon, said loop extending through an opening in said teething member.

2. The apparatus according to claim 1, wherein:

said perimeter edge of each of said plates has a groove therein being coextensive with said perimeter edge; and each of said grommets having an inner flange, each of said flanges being insertably mounted into one of said grooves of said plates.

3. The apparatus according to claim 1, wherein said teething member includes an outer sheath encapsulating a cushioning material therein, said outer sheath comprising a flexible material, said cushioning material comprising a fluid.

4. The apparatus according to claim 1, wherein said metallic material comprises stainless steel.

5. A child's entertainment apparatus configured for play and chewing, said apparatus comprising:

a loop, said loop being closed and free of any breaks;

a plurality of plates, each of said plates having a top surface, a bottom surface and a perimeter edge, said perimeter edge of each of said plates having a groove therein being coextensive with said perimeter edge, each of said plates having an aperture therein extending into corresponding ones of said top surfaces and said bottom surfaces, each of said apertures being located near one of said perimeter edges, said loop extending through each of said apertures, each of said plates having the shape of a key, each of said plates comprising a metallic material, said metallic material comprising stainless steel;

a plurality of grommets comprising a resiliently compressible material, each of said grommets having an inner flange, each of said flanges being insertably mounted into one of said grooves of said plates, said grommets covering an associated one of said perimeter edges; and a teething member mounted on said loop, said teething member being configured to provide comfort to a child while being bit upon, said teething member having a singular convexly arcuate outer surface, said member having an opening extending therethrough, said loop extending through said teething member opening, said teething member including an outer sheath encapsulating a cushioning material therein, said outer sheath comprising a flexible material, said cushioning material comprising a fluid.

* * * * *